US005741764A

United States Patent [19]

Patel et al.

[11] Patent Number: 5,741,764

[45] Date of Patent: Apr. 21, 1998

[54] TWO-CYCLE LUBRICANT CONTAINING SOLVENT AND HIGH MOLECULAR WEIGHT POLYMER

[75] Inventors: Jayram D. Patel, Eastlake; William K. S. Cleveland, Mentor-on-the-Lake, both of Ohio

[73] Assignee: The Lubrizol Corporation, Wickliffe, Ohio

[21] Appl. No.: 731,631

[22] Filed: Oct. 15, 1996

[51] Int. Cl.[6] ..... C10M 145/00

[52] U.S. Cl. ..... 508/459; 508/591; 585/1; 585/12; 585/14

[58] Field of Search ..... 508/591, 459; 585/1, 12, 14

[56] References Cited

U.S. PATENT DOCUMENTS

| | | | |
|---|---|---|---|
| 2,896,593 | 7/1959 | Riemenschneider | 123/1 |
| 3,004,836 | 10/1961 | Riemenschneider | 44/58 |
| 3,085,978 | 4/1963 | Mitacek et al. | 252/33.4 |
| 3,518,197 | 6/1970 | Eckert | 252/56 |
| 3,687,849 | 8/1972 | Abbott | 252/47.5 |
| 3,838,049 | 9/1974 | Souillard et al. | 252/32.7 E |
| 3,953,179 | 4/1976 | Souillard et al. | 44/58 |
| 3,994,815 | 11/1976 | Coleman | 508/591 |
| 4,304,678 | 12/1981 | Schick et al. | 252/56 |
| 4,740,321 | 4/1988 | Davis et al. | 252/33.4 |
| 4,759,860 | 7/1988 | Tanaka et al. | 252/32.5 |
| 4,877,836 | 10/1989 | Rhodes | 508/591 |
| 5,049,291 | 9/1991 | Miyaji et al. | 252/33 |
| 5,151,204 | 9/1992 | Struglinski | 508/591 |
| 5,304,315 | 4/1994 | Stover | 252/51.5 A |
| 5,366,644 | 11/1994 | Wicks | 252/12 |
| 5,446,221 | 8/1995 | Straylinski | 508/591 |
| 5,475,171 | 12/1995 | McMahon | 585/2 |
| 5,624,890 | 4/1997 | Kagaya et al. | 585/12 |

*Primary Examiner*—Jacqueline V. Howard
*Attorney, Agent, or Firm*—David M. Shold

[57] ABSTRACT

A composition of an oil of lubricating viscosity; a polymer, soluble in the lubricant composition and having a number average molecular weight of greater than 50,000; and a combustible solvent in which the remaining components of the lubricant are soluble, provides a composition suitable for lubricating a two-stroke cycle engine. The lubricant composition provides good lubricity with low smoke generation.

52 Claims, No Drawings

TWO-CYCLE LUBRICANT CONTAINING SOLVENT AND HIGH MOLECULAR WEIGHT POLYMER

BACKGROUND OF THE INVENTION

The present invention relates to a lubricant composition and method for lubricating a two-stroke cycle engine.

Two-stroke cycle engines are widely used for portable power equipment and represent an important portion of the engines used in transportation, particularly in the developing regions of the world. The lubricants required for the operation of two-stroke cycle engines are, in most designs, mixed with the liquid fuel, and this fuel-lubricant mixture is passed through the crankcase and, ultimately, to the combustion chambers, where the entire composition is ultimately burned. It is important, in such engines, to provide a lubricant composition which maintains suitable properties of lubricity while not contributing significantly to smoke formation or other types of pollution, all of which while maintaining an acceptably low cost. In the past, formulators have added relatively high levels of bright stock to serve as a lubricity agent, but this approach can lead to smoke generation. Alternatively, relatively high amounts of low molecular weight polymer have been added, but this approach can lead to the formation of sticky deposits and can, moreover, be a negative cost factor.

U.S. Pat. No. 4,759,860, Tanaka et al., Jul. 27, 1988, discloses a two-cycle engine oil composition which comprises a selected terpene compound incorporated in a substance selected from mineral oil, synthetic oil, a polyolefin and a mixture thereof. The weight average molecular weight of the polyolefin may generally be within the range of 250 to 200,000, preferably 300 to 5,000. Polybutene C, employed in Tables 1 and 2, is a product of ESSO Corp. (molecular weight: 80,000). The polyolefin is present in amounts of 5–89% by weight, preferably 10–50%. Amounts of less than 5% by weight of the polyolefin will fail to bring about significant smoke-reducing effect. In certain of the examples in Table 1, detergent dispersants are incorporated.

U.S. Pat. No. b 5,049,291,Miyaji et al, Sept. 17, 1991, discloses a lubricating oil composition for two-cycle engine comprising (A) certain α-olefin polymers, preferably having a kinematic viscosity of 2 to 600 cSt (B) a polybutene having a similar viscosity, (C) 5–50% of a hydrocarbonaceous solvent, and (D) a lubricating oil additive for two-cycle engines.

U.S. Pat. No. 3,687,849, Abbott, Aug. 29, 1972, discloses graft polymers prepared from various polymerizable unsaturated monomers and an oxidized, degraded interpolymer of ethylene and propylene. The polymers are useful as viscosity index improvers, dispersants and pour point depressants for fuels and lubricants. An interpolymer having a molecular weight of about 2000–200,000, preferably 3000–5000, is preferred. The polymers can be effectively employed in a variety of lubricating and fuel compositions, including two-cycle engine lubricants. Lubricants prepared (for Table I) include a basic calcium petroleum sulfonate.

U.S. Pat. No. 3,085,978, Mitacek et al., Apr. 16, 1963, discloses an internal combustion engine lubricant. The additive blend is for compounding into a lubricant, mixed into motor fuel for two cycle internal combustion engines. The additive blend consists essentially of an alkaline earth metal salt of a petroleum sulfonic acid and a polymer of isobutylene. The polyisobutylene a molecular weight in the range of about 1,000 to about 50,000, preferably 10,000 to 15,000. Typically 0.1 to 2 volume percent of the polymer are employed based on the lubricant.

SUMMARY OF THE INVENTION

The present invention provides a lubricant composition suitable for lubricating a two-stroke cycle engine, comprising:

(a) an oil of lubricating viscosity;

(b) about 0.2 to about 10 percent by weight of a polymer, soluble in said lubricant composition, having a number average molecular weight of greater than 50,000;

(c) 0 to about 10 percent by weight of an olefin polymer having a number average molecular weight of up to 500; and (d) about 10 to about 95 percent by weight of a combustible solvent other than oil of lubricating viscosity, having a flash point of less than about 105° C., in which the remaining components of the lubricant are soluble.

The invention further provides a fuel composition comprising a liquid fuel and the above-described lubricant composition.

The invention further provides a method for lubricating a two-stroke cycle engine, comprising supplying the above-described lubricant composition to the engine.

DETAILED DESCRIPTION OF THE INVENTION

The first component of the present invention is an oil of lubricating viscosity, including natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of dicarboxylic acids and polyols, esters of phosphorus-containing acids, polymeric tetrahydrofurans and silicon-based oils.

Specific examples of the oils of lubricating viscosity are described in U.S. Pat. No. 4,326,972 and European Patent Publication 107,282. A basic, brief description of lubricant base oils appears in an article by D. V. Brock, "Lubricant Base Oils", *Lubrication Engineering*, Volume 43, pages 184–185, March, 1987. This article may be consulted for its disclosures relating to lubricating oils. A additional description of oils of lubricating viscosity occurs in U.S. Pat. No. 4,582,618 (column 2, line 37 through column 3, line 63, inclusive ), which may be consulted for its disclosure to oils of lubricating viscosity.

The amount of the oil of lubricating viscosity is the amount suitable to complete the composition to 100%, after the other components are accounted for. While the amount can be as low as 1 or 2 percent by weight, typically the amount will be 20 to 89 percent by weight of the lubricant composition, preferably 50 to 85%, more preferably 70 to 80 percent.

The second component of the present invention is a polymer of relatively high molecular weight, which is soluble in the lubricant composition. This polymer will preferably have a number average molecular weight of above 50,000, more preferably 70,000 to 200,000, and still more preferably 80,000 to 140,000.

The high molecular weight polymer will exhibit a sufficient solubility in the lubricant composition as a whole, and in the solvent (described below) in particular, in order to be dissolved and remain in solution at the particular concentration employed. The terms "soluble," "solubility," "solution," and the like as referred to throughout this specification, are intended to represent a practical, rather than a theoretical concept. It might be debated whether, under a given set of conditions, an apparent solution of a polymer or another substance is a true solution or is actually a very fine, stable emulsion or dispersion. All such states are intended to be encompassed herein by the concept of solubility. The solutions in question thus are those states in which significant separation or settling of the components does not normally occur over commercially reasonable time periods, e.g., months.

The amount of the high molecular weight polymer will generally 0.2 to 10 percent by weight of the lubricant composition, preferably 0.5 to 8 percent, and more preferably 1 to 4 percent.

The high molecular weight polymer can be selected from any of a variety of polymers, including those polymers known as viscosity index modifiers or viscosity index improvers. Hydrocarbon polymers can be used as viscosity index improvers. Examples of suitable hydrocarbon polymers include homopolymers and copolymers of two or more monomers of $C_2$ to $C_{30}$, e.g., $C_2$ to $C_8$ olefins, including both alphaolefins and internal olefins, which may be straight or branched, aliphatic, aroamtic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylene, homopolymers and copolymers of $C_6$ and higher alhpaolefins, atactic polypropylene hydrogenated polymers and copolymers and terpolymers of styrene, e.g., with isoprene and/or butadiene. Polyisobutylene, has been used as a viscosity modifier in lubricating oils, and is suitable in present application provided its number average molecular weight is acceptably selected.

Ethylene-propylene copolymers, generally referred to as OCP's, can also be used as viscosity index modifiers. These materials can be prepared by copolymerizing ethylene and propylene, generally in a solvent, using known catalysts such as a Ziegler-Natta initiator. The ratio of ethylene to propylene in the polymer influences the oil-solubility, oil-thickening ability, low temperature viscosity, pour point depressant capability, and engine performance of the product. The common range of ethylene content is 45–60% by weight and typically is from 50% to about 55% by weight. Some commercial OCP's are terpolymers of ethylene, propylene and a small amount of non-conjugated diene such as 1,4-hexadiene. In the rubber industry, such terpolymers are referred to as EPDM (ethylene propylene diene monomer). The use of OCP's as viscosity modifiers in lubricant oils has increased rapidly since about 1970, and the OCP's are currently one of the most widely used viscosity modifiers.

Hydrogenated styrene-conjugated diene copolymers are another class of commercially available viscosity modifiers. These polymers include polymers which may be described as hydogenated or partially hydrenated homopolymers, and random, tapered, star, or block interpolymers (including terpolymers, tetrapolymers, etc.). Examples of styrenes include styrene, alpha-methyl styrene, ortho-methyl styrene, meta-methyl styrene, para-methyl styrene, paratertiary butyl styrene, etc. Preferably the conjugated diene contains from four to six carbon atoms. Examples of conjugated dienes include piperylene, 2,3-dimethyl-1,3-butadiene, chloroprene, isoprene, and 1,3-butadiene, with isoprene and butadiene being particularly preferred. Mixtures of such conjugated dienes are useful.

The styrene content of these copolymers is in the range of about 20% to about 70% by weight, preferably about 40% to about 60% by weight. The aliphatic conjugated diene content of these copolymers is in the range of about 30% to about 80% by weight, preferably about 40% to about 60% by weight. These copolymers can be prepared by methods well known in the art. Such copolymers usually are prepared by anionic polymerization using, for example, an alkali metal hydrocarbon (e.g., sec-butyllithium) as a polymerization catalyst. Other polymerization techniques such as emulsion polymerization can be used.

These copolymers are hydrogenated in solution so as to remove a substantial portion of their olefinic double bonds. Techniques for accomplishing this hydrogenation are well known to those of skill in the art and need not be described in detail at this point. Briefly, hydrogenation is accomplished by contacting the copolymers with hydrogen at super-atmospheric pressures in the presence of a metal catalyst such as colloidal nickel, palladium supported on charcoal, etc.

In general, it is preferred that these copolymers, for reasons of oxidative stability, contain no more than about 5% and preferably no more than about 0.5% residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible olefinic unsaturation.

The above-described hydrogenated copolymers and others have been described in the prior art such as in U.S. Pat. No. 3,554,911. This reference describes a hydrogenated random butadiene-styrene copolymer, its preparation, and hydrogenation. Hydrogenated styrene-butadiene copolymers useful as viscosity modifiers in the lubricating oil compositions of the present invention are available commercially from, for example, BASF under the general trade designation "Glissoviscal." A particular example is a hydrogenated styrene-butadiene copolymer available under the designation Glissoviscal 5260, which has a number average molecular weight of about 120,000. Hydrogenated styrene-isoprene copolymers useful as viscosity modifiers are available from, for example, The Shell Chemical Company under the general trade designation "Shellvis." Shellvis 40 from Shell Chemical Company is identified as a diblock copolymer of styrene and isoprene having a number average molecular weight of about 155,000, a styrene content of about 19 mole percent, and a isoprene content of about 81 mole percent. Shellvis 50 is available from Shell Chemical Company and is identified as a diblock copolymer of styrene and isoprene having a number average molecular weight of about 100,000, a styrene content of about 28 mole percent, and an isoprene content of about 72 mole percent.

Suitable materials generally include polymers which comprise monomer units derived from an ethyleneically unaturated acid or derivatives thereof, such as amides, salts, and, especially, esters.

Polymethacrylates (PMA) are also used as viscosity modifiers. These materials are prepared from mixtures of methacrylate monomers having different alkyl groups. The alkyl groups may be either straight chain or branched chain groups containing from 1 to about 18 carbon atoms. Most PMA's are viscosity modifiers as well as pour point depressants.

When a small amount of a nitrogen-containing monomer is copolymerized with alkyl methacrylates, dispersancy properties are also incorporated into the product. Thus, such a product has the multiple function of viscosity modification, pour point depressancy and dispersancy. Such products have been referred to in the art as dispersant-type viscosity modifiers or simply dispersant-viscosity modifiers. Vinyl pyridine, N-vinyl pyrrolidone, N-(1-methyl-vinyl) pyrrolidone, N-vinyl-5-methylpyrrolidone, N-vinyl-3,3-dimethylpyrrolidone, N-vinyl-5-ethyl pyrrolidone, and N,N'-dimethylaminoethyl methacrylate are examples of nitrogen-containing monomers. Polyacrylates obtained from the polymerization or copolymerization of one or more alkyl acrylates also are useful as viscosity modifiers.

Esters obtained by copolymerizing stryene and maleic anhydride in the presence of a free radical initiator and thereafter esterifying the copolymer with a mixture of $C_{4-18}$ alcohols also are useful as viscosity modifying additives. The styrene esters generally are considered to be multi-functional premium viscosity modifiers. The styrene esters in addition to their viscosity-modifying properties also are pour point depressants and exhibit dispersancy properties when the esterification is terminated before its completion leaving some unreacted anhydride or carboxylic acid groups. These acid groups can then be converted to imides by reaction with a primary amine.

Other viscosity improvers include but are not limited to polyvinylpyrrolidones, vinylpyrrolidone/acrylate or methacrylate copolymers, styrene/ acrylate or methacrylate copolymers, diene polymers, polyalkyl styrenes, alkenyl aryl conjugated diene copolymers, and polyolefins generally.

Polyolefins, in general, can be prepared by polymerization of olefins by well-known techniques. Examples of olefins include ethylene and other olefins having 3 to 40, preferably 4 to 24, carbon atoms. Olefins include alpha-olefins, sometimes referred to as 1-olefins or terminal olefins, which include, for example propylene and 1-butene, 1-pentene, 1-hexene, 1-heptene, 1-octene, 1-nonene, 1-decene, 1-tridecene, 1-tetradecene, 1-pentadecene, 1-hexadecene, 1-heptadecene, 1-octadecene, 1-nonadecene, 1-eicosene, 1-heneicosene, 1-docosene, and 1-tetracosene. Commercially available alpha-olefin fractions are also available, including the $C_{15-18}$ alpha-olefins, $C_{12-16}$ alpha-olefins, $C_{14-16}$ alpha-olefins, $C_{14-18}$ alpha olefins, $C_{16-18}$ alpha-olefins, $C_{16-20}$ alpha-olefins, $C_{18-24}$ alpha olefins, and $C_{22-28}$ alpha-olefins. Olefins also include non-terminally unsaturated materials and also include both linear and branched materials. An important branched olefin is isobutene.

The third component of the present invention is an optional component, which comprises a low molecular weight olefin polymer. Olefin polymers have been described above, as to their general chemical composition, and this description applies equally well to the present low molecular weight olefin polymers. Such low molecular weight polymers are commonly employed in lubricant systems for two-stroke cycle engines, and butylene polymers are thus among the preferred materials for use as this component of the present invention.

An important feature of the present invention is that the low molecular weight olefin polymer is present in the lubricant only at a low level, or is entirely or substantially entirely absent. Thus, in a broad sense, the composition of the present invention contains 0 to 10 percent by weight of an olefin polymer having a number average molecular weight of 500 or less. The amount of this component is preferably 0 to 5 percent, and more preferably 0 to 2 percent by weight. In one preferred embodiment, the lubricating composition is substantially free from such polymer.

The preferred compositions are similarly free from large quantities of olefin polymers having somewhat higher molecular weights as well, for instance, polymers having a number average molecular weight of 1000 or less, 2000 or less, 5000 or less, or even 10,000 or 15,000 or less. Thus in the preferred embodiment the composition will contain 0 to 10 percent by weight of an olefin polymer having a number average molecular weight of 5000 or less. In more preferred compositions the amount of this component is 0 to 5 percent, and more preferably 0 to 2 percent by weight, or is even substantially free from such a polymer. The present invention permits such low molecular weight polymers to be removed largely or entirely from the composition, while still retaining good lubricity properties. However, the relatively low amounts described above may be desired under some circumstances, and are thus considered to be included within the scope of the present invention. For instance, some useful compositions can contain 3–8 percent by weight of an olefin polymer such is polyisobutylene, having a number average molecular weight in the range of 800 to 1500.

The present lubricant composition likewise comprises a comparatively large amount of a combustible solvent (other than the oil of lubricating viscosity), an in which the remaining component of the lubricant are soluble. The solvent should be combustible because it is ultimately designed to be consumed in the engine, and non-combustible character is undesirable. In order to ensure suitable combustibility, the solvent should have a flash point (ASTM D-93) of less than 105° C. (220° F.), preferably less than 100° C. (212° F.), and more preferably less than 90° C. (194° F.). In order to assure safety in handling, the solvent will preferably have a flash point of 32° C. (90° F.) or above, and preferably 60° C. (140° F.) or above.

As an alternative description of the solvent, it can be said that it has a suitable degree of volatility. That is, its distillation characteristics (ASTM-D 86) are such that its 90% point is less than or equal to 246° C. (475° F.) and its dry point is less than or equal to 288° C. (550° F.). In preferred solvents the 90% point will be less than or equal to 232° C. (450° F.), and the dry point will be less than or equal to 246° C. (475° F.).

The solvent should be a material in which the remaining components of the lubricant composition are soluble. Ideally the remaining components will be soluble or miscible with the solvent in all proportions, but the more important consideration is that they be soluble in the concentrations in which they are employed in the actual lubricants of interest.

The solvent of the present invention is preferably a hydrocarbonaceous liquid. This term is used herein in a sense analogous to that of the common, related term "hydrocarbyl." The term "hydrocarbyl substituent" or "hydrocarbyl group" is well-known to those skilled in the art. Specifically, it refers to a group having a carbon atom directly attached to the remainder of a molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Thus, the hydrocarbonaceous solvent is one which exhibits principally hydrocarbon character, even though relatively small numbers of heteroatoms may be present in the molecule. The solvent is preferably a hydrocarbon, and preferably having predominantly non-aromatic (e.g., alkane) character. The solvent thus preferably comprises less than about 3 percent by weight aromatic components and is preferably substantially free from aromatic components. (Aromatic hydrocarbons, in sufficiently large quantity, tend to contribute to smoke upon combustion and are thus less desirable.) A particularly suitable solvent is kerosene, which is a non-aromatic petroleum distillate having a boiling range of 180–300° C.

The amount of the solvent is typically 15 to 95 percent by weight of the composition, preferably 20 to 60, 55, or 50 percent, and more preferably 25 to 40 percent by weight of the composition.

The composition of the present invention preferably also contains a cleanliness agent. Cleanliness agents are widely known and used in the field of engine lubrication technology, and are generally considered to comprise detergents and dispersants. Either or both of the material can be used.

Detergents are certain neutral or basic metal salts, including overbased materials. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. In many cases overbased materials are prepared by reacting an acidic material (typically an inorganic acid or lower carboxylic acid, preferably carbon dioxide, in which case the materials are referred to as "carbonated") with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The acidic organic material can be, for example, as carboxylic acid, sulfonic acid, phosphonic acid phenol, or a multifunctional material such as a salicylate or the condensate of an alkylphenol and glyoxylic acid, and will normally have at least one hydrocarbyl substituent.

The amount of excess metal in an overbased material is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5.

Such overbased materials are well known to those skilled in the art. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109, which can be consulted for detailed information.

Both basic materials and neutral salts can serve as detergents. The neutral salts are substantially the same as the overbased materials, except that they have not been treated with excess base and have a metal ratio of 1 or nearly 1.

Dispersants are well known in the field of lubricants. In most cases, dispersants are characterized by a polar group attached to a relatively high molecular weight hydrocarbon chain. Typical dispersants include N-substituted long chain alkenyl succinimides, having a variety of chemical structures including typically

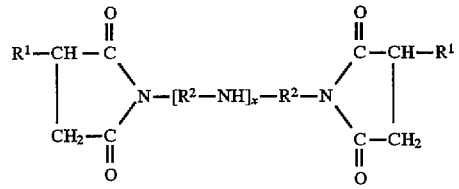

where each $R^1$ is independently an alkyl group, frequently a polyisobutyl group with a molecular weight of 500–5000, and $R^2$ are alkenyl groups, commonly ethylenyl ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. No. 4,234,435.

Another class of dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of dispersant is Mannich bases. These are materials which are formed by the condensation of a higher molecular weight, alkyl substituted phenol, an alkylene polyamine, and an aldehyde such as formaldehyde. Such materials may have the general structure

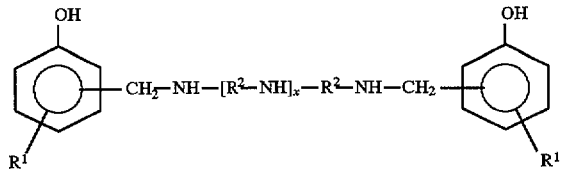

(including a variety of isomers and the like) and are described in more detail in U.S. Pat. No. 3,634,515.

Another type of material which can be generally be described as a dispersant are alkyl phenols, including those of the formula $(R)_a$—Ar—$(OH)_b$. As used herein, the term "phenol" is sued in its art-accepted generic sense to refer to hydroxy-aromatic compounds having at least one hydroxyl group bonded directly to a carbon of an aromatic ring. In the formula give, Ar represent an aromatic moiety, which can be a single aromatic nucleus such as benzene nucleus (which is preferred), a pyridine nucleus, a thiophene nucleus, a 1,2, 3,4-tetrahydronaphthalene nucleus, etc., or a polynuclear aromatic moiety. Polynuclear moieties can be of the fused type, such as found in naphthalene, anthracene, and the like, or of the linked type, wherein at least two nuclei are linked through bridging linkages to each other.

In the above formula, R represents a substantially saturated hydrocarbyl group, preferably containing at least about 10 aliphatic carbon atoms. More than one such group can be present, but usually, no more than 2 or 3 such groups are present for each aromatic nucleus in the aromatic moiety Ar. Usually each R contains at least 30, more typically at least 50 aliphatic carbon atoms, typically up to 400, more commonly up to 300. Other substituent groups may likewise be present, including, in particular, one or more amino groups.

Certain amines can also be employed as dispersants. Examples of useful amino compounds include aliphatic, cycloaliphatic, or heterocyclic amines and polyamines, and mixtures thereof. Polyamines are preferred. Aliphatic monoamines can be primary, secondary, or tertiary. Hydroxyamines can also be employed. Among aliphatic polyamines are alkylene polyamines including those having the formula $R'NR'(U—NR')_nR'$ where U is an alkylene group of 2 to 10 carbon atoms, each R' is independently a hydrogen atom, a lower alkyl group, a lower hydroxyalkyl group, or a lower aminoalkyl group (provided that at least on e R' is a hydrogen atom) and n is 1 to 10. Specific examples include methylene polyamine, ethylene polyamines, propylene polyamine, and butylene polyamines, including ethylenediamine, diethylene triamine, triethylene tetramine, and higher homologues, such as the polyalkylene polyamines (e.g., Jeffamine™).

Another related material is the product of the reaction of a fatty monocarboxylic acid of 12–30 carbon atoms and one or more of the afore-described alkylene amines. The fatty monocarboxylic acids are generally mixtures of straight and branched chain fatty carboxylic acid contains 12 to 30 carbon atoms. Branched chain fatty carboxylic acid/alkylene polyamine products have been described extensively in the art; in this regard, reference can be made to U.S. Pat. Nos. 3,110,673 and 3,857,791.

Other dispersants include polymeric dispersant additives, which are generally hydrocarbon-based polymers which contain polar functionality to impart dispersancy characteristics to the polymer. Included in this category are interpolymers of oil-solubilizing monomers such as decyl methacrylate, vinyl decyl ether, and high molecular weight olefins, with monomers containing polar substituents, e.g., aminoalkyl acrylates or acrylamides and poly-(oxyethylene) -substituted acrylates.

The required amount of the cleanliness agent, if it is present can be defined as a cleanliness-improving amount. That is, the agent should be present in an amount suitable for the detergent or dispersant to exhibit its desired performance by reducing sludge, varnish, and other deposit formation on the engine parts, including pistons, ports, and crankcase. The actual amount of the cleanliness agent is preferably 0.1 to 20 percent by weight, more preferably 0.3 to 10 percent by weight. When the cleanliness agent is a detergent, its amount is most preferably 0.5 to 3 percent by weight.

The lubricant composition can further, optionally, comprising a friction-reducing amount of a friction modifier. Friction modifiers include fatty esters, including include sorbitan and sorbitol partial carboxylic esters, such as sorbitan mono- di- and trioleates, as well as the corresponding stearate and laurate esters, or mixtures thereof; sorbitol mono-, di-, and trioleates, as well as the corresponding stearate and laurate esters, or mixtures thereof; glycerol fatty esters, such as glycerol monooleate, glycerol dioleate, the corresponding mono- and di-esters from $C_{10}$–$C_{22}$ acids such as stearic, isostearic, behenic, and lauric acids; corresponding mono- and diesters made from fatty acids and 2-methyl-2-hydroxymethyl-1,3-propanediol, 2-ethyl-2-hydroxymethyl-1,3-propanediol, and tris-hydroxymethylmethane; the mono-, di-, and triesters from $C_{10}$–$C_{22}$ fatty carboxylic acids and monopentaerythritol; the corresponding partial fatty acid esters of di-pentaerythritol. A preferred material is glycerol monooleate.

The amount of the friction modifier, if it is employed, will typically be 0.5 to 5 weight percent of the composition, preferably 1 to 3 weight percent.

The composition of the present invention can also contain, if desired, bright stock. Bright stock is a relatively high viscosity lubricating oil fraction which is often included in two-stroke cycle lubricants in order to provide improved lubricity, but at the expense of increased smoke generation. One of the advantages of the present invention is that a suitable lubricant can be formulated using only a limited amount of bright stock or completely in the absence of bright stock. Thus bright stock will typically be at a level of 0 to 12 percent by weight of the composition, preferably 2 to 8 percent by weight. It is also preferred that the formulation be prepared without added bright stock.

The lubricant compositions of the present invention can also contain other additives which are added in order to improve the fundamental properties of lubricants. These include antioxidants, metal deactivators, rust inhibitors, pour point depressants, high pressure additives, anti-wear additives, and anti-foam agents.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the compositions prepared by admixing the components described above.

The present invention further includes a fuel composition suitable for fueling a two-stroke cycle engine, comprising a liquid fuel (such as gasoline, kerosene, diesel fuel, and the like) and a lubricating amount of the lubricant described above. Such lubricant-fuel combinations are commonly employed in many two-stroke cycle engines. The lubricant can be added to the fuel when it is contained within the fuel tank; it can be premixed before the fuel is added to the tank; or it can be separately metered into the fuel stream during operation of the engine. The specific amount of the lubricant to be combined with the fuel will depend on the demands of the particular engine and the characteristics of the specific lubricant. Generally the amount of the lubricant composition is 0.5 to 10 percent by weight of the fuel plus lubricant combination, preferably 1 to 4 percent by weight.

The present invention further provides a method for lubricating a two-stroke cycle engine, comprising supplying to the engine a lubricant composition in any of its above-described modifications. More specifically, the present invention provides the lubricating method wherein the lubricant composition is admixed with a liquid fuel, and the mixture is supplied to the engine. Details of the lubrication of two-stroke cycle engines, in their various modifications, are well known to those skilled in the art.

EXAMPLES

Example 1

A lubricant composition is prepared of the following components:

(a) 46.05 parts by weight 600 N mineral oil (b) 0.75 parts by weight ethylene/propylene copolymer having an ethyl ethylene/propylene weight ratio of 57:43 and further containing about 1.3% by weight dicyclopentadiene; number average molecular weight 140,000 (by GPC, polystyrene equivalent)

(c) 5.0 parts by weight polyisobutylene, 1000 number average molecular weight (d) 40 parts by weight water white kerosene (e) 2.0 parts by weight glycerol monooleate (f) 6.0 parts of a conventional detergent/dispersant package containing about 60% active chemicals and about 40% diluent oil.

The sample is tested in the standard JASO Smoke Test Procedure M342-92, which, in summary, involves supplying fuel containing the lubricant additive in question to a Suzuki SX-800R air-cooled, single cylinder, two stroke-cycle gasoline engine with a 70 $cm^3$ displacement. The fuel:lubricant ratio is 50:1. The results are expressed in terms of smoke index, which is defined as the average maximum smoke opacity of one (or two) reference compositions, divided by the average maximum smoke opacity of the candidate composition, multiplied by 100. Higher values represent better results. The reference coposition is a standard oil formulation designated JETRE-1. Two test of the composition of Example 1 provide smoke index values of 100 and 85.

Examples 2–9

The following compositions are prepared, as indicated in the following table. The lubricants are evaluated for viscosity at 100° C. (in cSt) and are used to lubricate a Suzuki snowmobile engine equipped with a variable ratio oiler (VRO) supplying lubricant formulation in regular unleaded fuel. The visual smoke rating of the exhaust is indicated, where a rating of 10 indicates no smoke. The exhaust residue is likewise observed and evaluated.

| Ex.:→ | 2 | 3 | 4 | 5 | 6 | 7 | 8 | 9 |
|---|---|---|---|---|---|---|---|---|
| Oil, 350N | 68.1 | 58.1 | 34.1 | 69.1 | 64.1 | 73.1 | 58.1 | 0 |
| Ethylenel/propylene copolymer[a] | 1.0 | 6.0 | 0 | 0 | 0 | 6.0[b] | 0 | 14.3 |
| 950 mw polyisobutylene | 0 | 0 | 30 | 0 | 5 | 0 | 6 | 0 |
| Stoddard solvent | 25 | 30 | 30 | 25 | 25 | 15 | 30 | 71.6 |
| Additive package* | 5.9 | 5.9 | 5.9 | 5.9 | 5.9 | 5.9 | 5.9 | 5.9 |
| Viscosity | 8.13 | 210. | 6.11 | 3.69 | 4.04 | 102. | 3.52 | — |
| Smoke: | | | | | | | | |
| 1 min | 8.0 | — | — | — | — | 8.0 | — | 8.0 |
| 5 min | 7.0 | 6.5 | 4.0 | — | 5.0 | 7.5 | — | 7.5 |
| 10 min | 6.5 | 5.0 | — | — | — | 6.5 | — | 6.5 |
| Exhaust residue | c | d | e | — | f | g | — | h |

*standard package containing one or more antioxidants and detergents, dispersants, and/or surfactants, with diluent oil.
—value not determined
[a]ethylene/propylene ratio 51:49, further containing about 2% dicyclpentadiene number average molecular weight 140,000, except as noted.
[b]ethylene/propylene ratio 52:48; no diene; number average molecular weight 80,000.
[c]black, low volume, not tacky, less slippery than Ex. 3
[d]light, oily, slippery, no tackiness, greater volume than Ex. 4
[e]black, oily, slightly tacky, similar to Ex. 6
[f]black, oily, low viscosity, non-tacky -continued

| Ex.:→ | 2 | 3 | 4 | 5 | 6 | 7 | 8 | 9 |
|---|---|---|---|---|---|---|---|---|

[g]similar to Ex. 2, slightly less volume, no tackiness
[h]dark brown, small volume, low viscosity, no tack.

Examples 10–15

Samples of the compositions shown in the following table (amounts in parts by weight) are tested using the above-described JASO Smoke Test Procedure M342-92 (50:1 fuel:lubricant ratio). Results are shown in the table.

| Ex.:→ | 10 | 11 | 12[a] | 13 | 14 | 15 |
|---|---|---|---|---|---|---|
| Oil, Exxon ™ 600N | 53.8 | 78.8 | 0 | 0[b] | 56.0 | 62.2 |
| ethylene/propylene copolymer of Ex. 1 | 2 | 2 | 6 | 2 | 2 | 1 |
| Glycerol monooleate | 0 | 0 | 1 | 2 | 2 | 2 |
| Kerosene, water white | 40 | 15 | 93 | 91.8 | 40 | 30 |
| Conventional dispersant/detergent package of Ex. 1 | 4.2 | 4.2 | 0 | 4.2 | 0 | 4.8 |
| Smoke Index | 75.6 | 48.8 | —[c] | 1198 | 57, 48[d] | 47 |

[a]reference example
[b]composition contains about 2 parts oil from the dispersant/detergent package.
[c]not determined. Engine seized during test for undetermined reasons.
[d]duplicate tests Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A lubricant composition suitable for lubricating a two-stroke cycle engine, comprising:

(a) an oil of lubricating viscosity;

(b) about 0.2 to about 10 percent by weight of a polymer, soluble in said lubricant composition, having a number average molecular weight of greater than 50,000;

(c) 0 to about 10 percent by weight of an olefin polymer having a number average molecular weight of up to 500; and (d) about 10 to about 95 percent by weight of a combustible solvent other than oil of lubricating viscosity, having a flash point of less than about 105° C., in which the remaining components of the lubricant are soluble.

2. The lubricant composition of claim 1 wherein the polymer of (b) has a number average molecular weight of about 70,000 to about 200,000.

3. The lubricant composition of claim 1 wherein the polymer of (b) has a number average molecular weight of about 80,000 to about 140,000.

4. The lubricant composition of claim 1 wherein the amount of the polymer of (b) is about 0.5 to about 8 percent by weight.

5. The lubricant composition of claim 1 wherein the amount of the polymer of (b) is about 1 to about 4 percent by weight.

6. The lubricant composition of claim 1 wherein the polymer of component (b) is an olefin polymer.

7. The lubricant composition of claim 6 wherein the olefin polymer is a copolymer comprising monomer units derived from ethylene and from propylene.

8. The lubricant composition of claim 6 wherein the olefin polymer is a butylene polymer.

9. The lubricant composition of claim 1 wherein the polymer of component (b) comprises monomer units derived from an ethylenically unsaturated acid or a derivative thereof.

10. The lubricant composition of claim 1 wherein the compositions conatins about 3 to about 8 percent by weight of an olefin polymer having a number average molecular weight in the range of 800 to 1500.

11. The lubricant composition of claim 1 wherein the composition contains 0 to about 10 percent by weight of olefin polymer having a number average molecular weight of up to 5,000.

12. The lubricant composition of claim 11 wherein the composition contains 0 to about 5 percent by weight of the olefin polymer having a number average molecular weight of up to 5,000.

13. The lubricant composition of claim 11 wherein the composition contains 0 to about 2 percent by weight of the olefin polymer having a number average molecular weight of up to 5,000.

14. The lubricant composition of claim 11 wherein the composition is substantially free from olefin polymer having a number average molecular weight of up to 5,000.

15. The lubricant composition of claim 1 wherein the solvent is a hydrocarbonaceous liquid.

16. The lubricant composition of claim 15 wherein the hydrocarbonaceous liquid comprises less than about 3 percent by weight aromatic components.

17. The lubricant composition of claim 15 wherein the hydrocarbonaceous liquid is substantially free from aromatic components.

18. The lubricant composition of claim 1 wherein the solvent is kerosene.

19. The lubricant composition of claim 1 wherein the amount of the solvent is about 15 to about 60 percent by weight of the composition.

20. The lubricant composition of claim 1 wherein the amount of the solvent is about 20 to about 50 percent by weight of the composition.

21. The lubricant composition of claim 1 wherein the amount of the solvent is about 25 to about 40 percent by weight of the composition.

22. The lubricant composition of claim 1 further comprising a cleanliness-improving amount of a cleanliness agent.

23. The lubricant composition of claim 22 wherein the amount of the cleanliness agent is about 0.1 to about 20 percent by weight.

24. The lubricant composition of claim 22 wherein the cleanliness agent comprises a detergent or a dispersant.

25. The lubricant composition of claim 22 wherein the cleanliness agent comprises a detergent.

26. The lubricant composition of claim 25 wherein the detergent is an alkali or alkaline earth metal phenate, carboxylate, or sulfonate.

27. The lubricant composition of claim 25 wherein the amount of the detergent is about 0.5 to about 3 percent by weight.

28. The lubricating composition of claim 1 wherein the cleanliness agent comprises a dispersant.

29. The lubricant composition of claim 1 further comprising a friction-reducing amount of a friction modifier.

30. The lubricant composition of claim 29 wherein the friction modifier is a fatty ester.

31. The lubricant composition of claim 29 wherein the amount of the friction modifier is about 0.5 to about 5 percent by weight.

32. The lubricant composition of claim 1 wherein the composition contains 0 to about 12 percent by weight bright stock.

33. The lubricant composition of claim 32 wherein the amount of bright stock is about 2 to about 8 percent by weight.

34. The lubricant composition of claim 32 wherein the composition is substantially free from bright stock.

35. A composition prepared by admixing the components of claim 1.

36. A fuel composition suitable for fueling a two-stroke cycle engine, comprising a liquid fuel and a lubricating amount of the lubricant composition of claim 1.

37. The fuel composition of claim 36 wherein the amount of the lubricant composition is about 0.5 to about 10 percent by weight.

38. The fuel composition of claim 36 wherein the amount of the lubricant composition is about 1 to about 4 percent by weight.

39. A method for lubricating a two-stroke cycle engine, comprising supplying to the engine a lubricant composition comprising:

(a) an oil of lubricating viscosity;

(b) about 0.2 to about 10 percent by weight of a polymer, soluble in said lubricant composition, having a number average molecular weight of greater than 50,000;

(c) 0 to about 10 percent by weight of an olefin polymer having a number average molecular weight of up to 500; and (d) about 10 to about 95 percent by weight of a combustible solvent other than oil of lubricating viscosity, having a flash point of less than about 105° C., in which the remaining components of the lubricant are soluble.

40. The method of claim 39 wherein the polymer of component (b) is an olefin polymer.

41. The method of claim 39 wherein the lubricant composition contains 0 to about 10 percent by weight of olefin polymer having a number average molecular weight of up to 5,000.

42. The method of claim 39 wherein the amount of the olefin polymer having a number average molecular weight of up to 5,000 is 0 to about 5 percent by weight.

43. The method of claim 39 wherein the lubricant composition is substantially free from olefin polymer having a number average molecular weight of up to 5,000.

44. The method of claim 39 wherein the combustible solvent is kerosene.

45. The method of claim 39 wherein the amount of the combustible solvent is about 25 to about 40 percent by weight of the composition.

46. The method of claim 39 wherein the lubricant composition further comprises a cleanliness improving amount of a cleanliness agent.

47. The method of claim 46 wherein the cleanliness agent is a detergent.

48. The method of claim 46 wherein the cleanliness agent is a dispersant.

49. The method of claim 39 wherein the lubricant composition contains 0 to about 12 percent by weight bright stock.

50. The method of claim 39 wherein the lubricant composition is substantially free from bright stock.

51. The method of claim 39 wherein the lubricant composition further comprises a friction-reducing amount of a friction modifier.

52. The method of claim 39 wherein the lubricant composition is admixed with a liquid fuel and the lubricant-fuel mixture is supplied to the engine.

* * * * *